United States Patent [19]

Multer

[11] Patent Number: 4,872,512

[45] Date of Patent: Oct. 10, 1989

[54] SUPPORT & ANCHOR ESCUTCHEON FOR SPRINKLER HEADS INSTALLED ON PIPE

[75] Inventor: Thomas L. Multer, Lilburn, Ga.

[73] Assignee: Lifeprotech, Inc., Stone Mountain, Ga.

[21] Appl. No.: 200,664

[22] Filed: May 31, 1988

[51] Int. Cl.[4] ..... A62C 37/08

[52] U.S. Cl. ..... 169/51; 169/37; 248/56

[58] Field of Search ..... 169/37, 41, 38, 39, 169/40, 51; 248/56, 27.1; 239/209; 137/359; 285/206, 205, 158

[56] References Cited

U.S. PATENT DOCUMENTS 572,911 12/1896 Schmidt .
913,265 2/1909 Coppage ..... 285/206
1,192,417 7/1916 Griffen ..... 285/206
2,181,758 11/1939 Goon et al. .
2,531,790 11/1950 Rowley ..... 169/38
2,871,953 2/1959 Bray .
3,039,536 6/1962 Moore et al. .
3,104,120 9/1963 Myers ..... 285/206
4,117,887 10/1978 Anderson .
4,366,866 1/1983 Sweeney .
4,437,611 3/1984 Gilroy .

*Primary Examiner*—Sherman D. Basinger
*Assistant Examiner*—Anne Sartelle
*Attorney, Agent, or Firm*—Jones, Askew & Lunsford

[57] ABSTRACT

An escutcheon plate assembly that provides partial support for flexible sprinkler piping systems and the anchoring of sprinkler heads in ceiling and wall. The plate assembly also provides proper alignment to the attachment surfaces.

2 Claims, 1 Drawing Sheet

SUPPORT & ANCHOR ESCUTCHEON FOR SPRINKLER HEADS INSTALLED ON PIPE

BACKGROUND OF THE INVENTION

The present invention relates to an assembly for anchoring sprinkler heads to ceilings and walls without using additional clamps, hangers, or brackets. In existing buildings, sprinkler heads may be installed without cutting access holes at sprinkler head locations for the installation of additional supports, clamps, hangars, and brackets.

DESCRIPTION OF THE PRIOR ART

Because of its flexibility, alignment and restraint procedures, flexible pipe systems are somewhat different than those used for rigid pipe. Water flowing through a fused sprinkler can generate a small amount of force, generally less than 5 lbs., which could cause the pipe and fitting to move, unless they, or the sprinkler itself, are restrained. This movement could result in an unacceptable water spray pattern. Sprinklers are known in the art which can be secured with special fittings that have mounting holes or special escutcheon plates that lock into the sprinkler, where they can be anchored to the wall or ceiling with screws or toggle bolts.

U.S. Pat. No. 2,871,973 issued to Bray, discloses a pendent sprinkler having a ceiling plate into which is screwed a sprinkler head and which itself is fastened to the ceiling or wall by a set of screws.

U.S. Pat. No. 4,366,866 issued to Sweeney, discloses a split escutcheon system comprising a split escutcheon plate, the two halves of which interlock to form the decorative escutcheon. A hole in the middle of the assembled escutcheon fits around the sprinkler head portion which is fitted into the pipe.

U.S. Pat. No. 2,181,758 issued to Goon et al., discloses a valved fluid unit having a face plate which is mounted to a wall by a pair of screws. These patents involve the fastening of the face plate to one side of the wall by using an independent fastening means such as a screw or the like. The additional steps of aligning and mounting the screws adds to the installation time and effort. Furthermore, as in the case of the Sweeney patent, no additional substantial support or anchoring is provided by the escutcheons.

U.S. Pat. No. 572,911, issued to Schmidt, discloses a faucet assembly having a ring and flange adapted to fit over the shank of the faucet which passes through a wall surface. The shank is threaded and the ring and flange compress the faces of the wall material on one side by a nut which screws onto the stem of the shank, and on the other side by a shoulder which is part of the faucet shank. The above-described patents are all incorporated by reference in their entirety herein.

There are many disadvantages to the current systems of anchoring the sprinkler head and providing proper alignment. They require the installation of extra unnecessary materials such as, extra clamps, hangars, brackets or straps. These methods not only require extra materials involved for the support and anchoring of the sprinkler head, they also require extra labor to install these supports.

SUMMARY OF THE INVENTION

Accordingly, it is the object of the present invention to provide a support and anchor escutcheon for sprinkler heads that is easier and more economical to install and provides better support and anchoring capabilities.

It is a further objective of this invention to eliminate extra framing and supports to align and hold the sprinkler head and to secure the head and flexible piping in a simple operation.

It is a further objective of this invention to eliminate or reduce the number of access holes required to install sprinkler heads in existing buildings.

It is a further objective of this invention to ensure proper alignment of the sprinkler heads to walls and ceilings.

In accordance with the present invention, an escutcheon system is disclosed which comprises a two-piece plate assembly. An inner plate has a flange that grips the supporting wall or ceiling surface. It has male threads that mate with the outer plate. In the center of the inner plate there is a hole that is threaded to accept the male threads of a sprinkler head. The flange on this inner plate has two raised nipples that grip the surface to which the plate is attached. An outer plate has complementary threads that mate with the inner plate to provide a sandwich-type assembly. This ring also grips the wall or ceiling for support. This outer plate has two small holes for pin lug wrench tightening. The tightening of the outer ring to the inner ring provides a compression or sandwich-type grip to a wall or ceiling surface.

More particularly, disclosed is a support and anchor escutcheon assembly, comprising a first cylinder containing one open end, a set of threads on its outer wall and having a radial flange extending radially outward from the open end of the cylinder and the other end of the cylinder being partially closed, wherein a hole is bored longitudinally in the partially closed end and the inner wall of the hole is threaded; and an open ended second cylinder having a set of mateable threads on the inner wall of the cylinder capable of operatively connecting with the first cylinder, the cylinder being sized to matably receive the first cylinder, and having a flange extending radially outward from one end of the second cylinder, the other end of the second cylinder being open, wherein when the first cylinder and the second cylinder are threaded to each other the flanges exert a sandwich pressure on a material placed between the flanges.

DETAILED DESCRIPTION OF THE INVENTION

While the invention will be described in connection with the preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
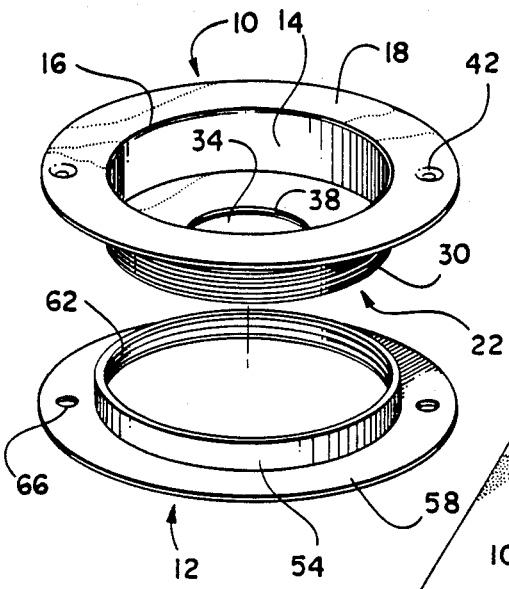
FIG. 1 shows the escutcheon assembly in a preferred embodiment of the present invention.

Turning to FIG. 1, in which like numbers represent like parts, there is shown a two-piece escutcheon assembly having an inner plate 10 which is matched with an outer place 12. The inner plate 10 consists of a cylinder 14 having an open end 16 and a partially closed end 22. The cylinder can be made of any conventional rigid material and is preferably made of a metallic substance. A set of threads 30 is cut on the outside wall of the cylinder 14 and extends from the partially closed end 22 along substantially the entire length of the cylinder towards the open end 16.

A flange 18 extends radially outward from the open end 16 of the cylinder 14. The flange 18 is preferably substantially planer, but can be ribbed or grooved in order to grip a surface, as will be more fully described herein below.

A hole 34 is bored through the center of the partially closed end 22 and is sized to accept a threaded sprinkler head as will be more described herein below. A set of threads 38 is cut into the inner wall of the hole 34. In a preferred embodiment, the flange 18 has at least one nipple 42 extending from its surface toward the partially closed end 22. The purpose of the nipple 42 is to grip the surface to which the plate 10 is attached.

The outer plate 12 consists of an open cylinder 54, having a flange 58 extend radially outward from one end of the cylinder in a fashion similar to the flange 18. A set of threads 62 is cut into the inner wall of the cylinder 54 which are complementary to the threads 30 of the inner plate 10. The inner plate 10 and outer plate 12 are thus connectable by means of these sets of complementary threads.

In a preferred embodiment, at least one hole 66 is cut into the flange 58 to facilitate tightening of the plates to each other with a pin lug wrench. It is to be understood that it is within the scope of this invention for the nipples 42 and the holes 66 to be on either one or both of the flanges 18 and 58.

Figure 2:
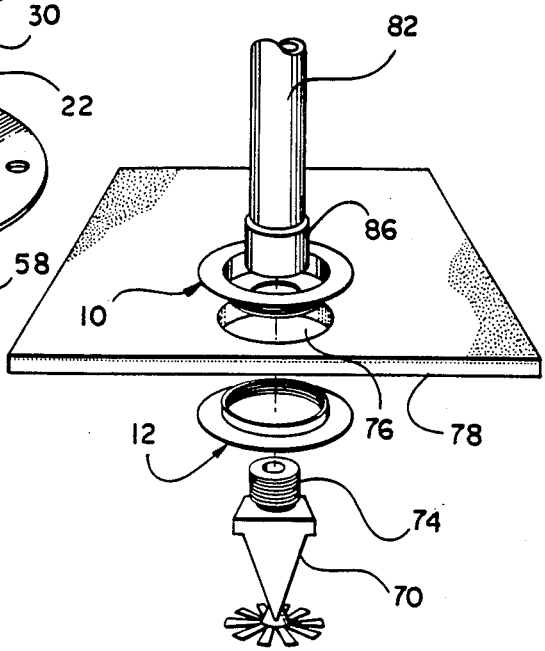
FIG. 2 shows an expanded view of a typical sprinkler system using the escutcheon assembly of the present invention.

Turning to FIG. 2, the escutcheon assembly of the present invention is shown with a conventional sprinkler system. A conventional sprinkler head 70 having a set of threads 74 can connect to the inner plate 10 by means of the threads 38. The sprinkler head 70 also is coupled to pipe 82 by means of a pipe coupling 86 which has a set of threads cut into its inner wall (not shown).

Figure 3:
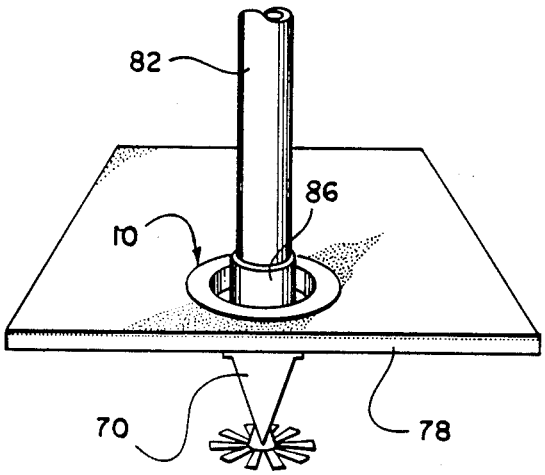
FIG. 3 shows an assembled view of a typical sprinkler system using the escutcheon assembly of the present invention.

The sprinkler system, including the escutcheon assembly of the present invention, is assembled in the following manner. The first step is to cut a hole 76 in the ceiling or wall material 78 to receive the cylinder 14 of the inner plate 10. Then the sprinkler head 70 is attached to the inner plate 10 by means of the threads 74 which are screwed into the threads 38. The sprinkler head threads 74 are then screwed into the pipe coupling 86, which is already attached to pipe 82. This assembly is then inserted through the hole 76 in the ceiling or wall material 78. The outer plate 12 is then screwed onto the inner plate 10 on the opposite face of the material 78 as the flange 18 so that the flanges 18 and 58 grip both faces of the material 78. The plates 10 and 12 are then tightened to the surface of the material 78 by means of the holes 66 which provide a gripping surface for a pin lug wrench. The compression of the two plates provides a stable support for the pipe 82 and its attached sprinkler head 70 which keeps the sprinkler head 70 in alignment with the ceiling or wall surface 78. The assembled sprinkler head assembly is shown in FIG. 3.

In an alternative embodiment, the flanges 18 and 58 can have uneven surfaces so as to enhance the ability of the flanges 18 and 58 to grip the material 78. This will also reduce the possibility of the plates loosening due to any vibration or other movement of the pipe and sprinkler head assembly.

What is claimed is:

1. A method for anchoring and supporting a sprinkler head attached to a pipe within a hole, comprising;

(a) providing a first cylinder containing one open end, a set of threads on its outer wall and having a radial flange extending radially outward from said open end of said cylinder and the other end of said cylinder being partially closed, wherein a hole is bored longitudinally in said partially closed end and the inner wall of said hole is threaded; and an open ended second cylinder having a set of matable threads on the inner wall of said cylinder capable of operatively connecting with said first cylinder, said cylinder being sized to matably receive said first cylinder, and having a flange extending radially outward from one end of said second cylinder, the other end of said second cylinder being open, wherein when said first cylinder and said second cylinder are threaded to each other said flanges exert a sandwich pressure on a material placed between said flanges;

(b) cutting a hole in the material into which said pipe is to be secured;

(c) screwing said sprinkler head into said threaded hole in said first cylinder;

(d) attaching said sprinkler head to said pipe such that said first cylinder and said sprinkler head are attached to said pipe;

(e) inserting the assembly of step (c) through said hole of step (a) in one side of said material as;

(f) inserting said second cylinder into the opposite side of said material as said first cylinder (g) screwing said second cylinder onto said first cylinder such that said material is sandwiched between said flanges; and (h) tightening said first and second cylinders whereby said flanges provide a compression joint such that said sprinkler head is in alignment with said material and is secured thereto.

2. A sprinkler support system, comprising a sprinkler head;

a means for delivering fluid to said sprinkler head comprising a pipe couplable to said sprinkler head;

a material to which said sprinkler head is to be anchored; and a support and anchor escutcheon assembly, comprising:

a first cylinder containing one open end, a set of threads on its outer wall and having a radial flange extending radially outward from said open end of said cylinder and the other end of said cylinder being partially closed, wherein a hole is bored longitudinally in said partially closed end and the inner wall of said hole is threaded; and an open ended second cylinder having a set of matable threads on the inner wall of said cylinder capable of operatively connecting with said first cylinder, said cylinder being sized to matably receive said first cylinder, and having a flange extending radially outward from one end of said second cylinder, the other end of said second cylinder being open, wherein when said first cylinder and said second cylinder are threaded to each other said flanges exert a sandwich pressure on a material placed between said flanges.

* * * * *